US005083169A

United States Patent [19]

Usui et al.

[11] Patent Number: 5,083,169

[45] Date of Patent: Jan. 21, 1992

[54] DEVICE FOR REMOVING DEPOSITS FROM A PHOTOCONDUCTIVE ELEMENT OF AN IMAGE RECORDER WHICH IS MOVABLE BETWEEN A CLEANING AND NON-CLEANING POSITION

[75] Inventors: Noriyuki Usui, Kawasaki; Hidenobu Endo, Tokyo, both of Japan

[73] Assignee: Ricoh Company, Ltd., Tokyo, Japan

[21] Appl. No.: 426,400

[22] Filed: Oct. 25, 1989

Related U.S. Application Data

[63] Continuation-in-part of Ser. No. 334,218, Apr. 6, 1989.

[30] Foreign Application Priority Data

Apr. 6, 1988 [JP] Japan ..... 63-83054
Apr. 19, 1988 [JP] Japan ..... 63-94665
Nov. 10, 1988 [JP] Japan ..... 63-282469

[51] Int. Cl.[5] ..... G03G 21/00

[52] U.S. Cl. ..... 355/296; 118/652; 355/301

[58] Field of Search ..... 355/301, 296, 282, 290, 355/206, 212, 204, 295, 299; 15/256.52; 118/652; 219/216

[56] References Cited

U.S. PATENT DOCUMENTS 3,819,263 6/1974 Draugelis et al. ..... 355/215
3,848,992 11/1974 Smith ..... 355/299
3,848,993 11/1974 Hasiotis ..... 355/299
3,900,591 8/1975 Kline ..... 355/282 X
3,947,108 3/1976 Thettu et al. ..... 355/301 X
4,183,658 1/1980 Winthaegen ..... 355/212
4,215,931 8/1980 Tsuda et al. ..... 355/206 X
4,426,151 1/1984 Aguro et al. ..... 118/652 X
4,449,241 5/1984 Nakayama ..... 355/301 X
4,561,762 12/1985 Watanabe et al. ..... 355/299
4,618,247 10/1986 Tsuji ..... 355/282 X
4,639,122 1/1987 Pease ..... 355/299
4,706,320 11/1987 Swift ..... 15/256.52 X
4,791,455 12/1988 Yamamoto et al. ..... 118/652 X

FOREIGN PATENT DOCUMENTS 0032334 3/1977 Japan ..... 355/301
0074574 6/1980 Japan ..... 355/301
0111577 7/1982 Japan ..... 355/302

*Primary Examiner*—A. T. Grimley
*Assistant Examiner*—William J. Royes
*Attorney, Agent, or Firm*—Oblon, Spivak, McClelland, Maier & Neustadt

[57] ABSTRACT

A device for removing deposits from the surface of a photoconductive element which is installed in an electrophotographic copier, facsimile machine, printer or similar image recorder. A rotatable fur-brush is movable into contact with the photoconductive element for removing deposits from the latter. The fur-brush is supported by an arm which is angularly movable between an operative position and an inoperative position assigned to the fur-brush. The arm is in turn driven by a pressing lever. When the image recorder is to start on a copying operation, the deposit removing operation is interrupted immediately. In a further embodiment, the fur-brush may also be movable in a reciprocating motion in the axial direction.

22 Claims, 13 Drawing Sheets

| |
|---|
| Fig. 4A |
| Fig. 4B |

| Fig. 5A |
| --- |
| Fig. 5B |

Fig. 6

| LINEAR VELOCITY OF BELT (mm/sec) \ DEPOSITS REMOVING TIME (sec) | 5 | 10 | 20 | 30 |
|---|---|---|---|---|
| 5 | ○ | ○ | ○ | ○ |
| 50 | × | △ | ○ | ○ |
| 100 | × | × | ○ | ○ |
| 300 | × | × | △ | ○ |

Fig. 8A
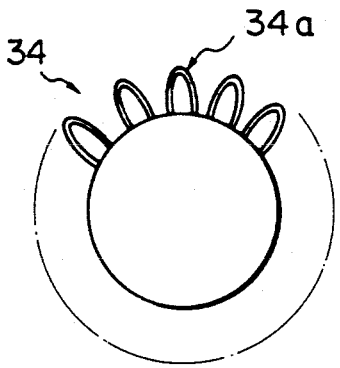
Fig. 8B
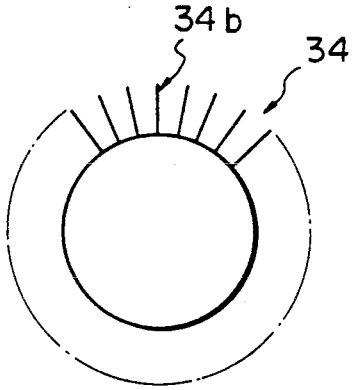
Fig. 9
| TIP CONFIGURATION | DIAMETER | REMOVABILITY | DAMAGE TO BELT |
|---|---|---|---|
| LOOPED | LESS THAN 6 μ | ○ | ○ |
| | 12 μ | ○ | ○ |
| | 20 μ | ○ | ○ |
| | 30 μ | ○ | ○ |
| | 40 μ | △ | × |
| STRAIGHT | 12 μ | △ | × |
| | 20 μ | ○ | × |

| Fig.10A |
| --- |
| Fig.10B |

DEVICE FOR REMOVING DEPOSITS FROM A PHOTOCONDUCTIVE ELEMENT OF AN IMAGE RECORDER WHICH IS MOVABLE BETWEEN A CLEANING AND NON-CLEANING POSITION

CROSS REFERENCE TO RELATED APPLICATION

This application is a continuation-in-part of copending U.S. patent application Ser. No. 07/334,218, filed Apr. 6, 1989.

BACKGROUND OF THE INVENTION

The present invention relates to a device for removing deposits from a photoconductive element which is installed in an electrophotographic copier, facsimile machine or similar image recorder.

In an image recorder of the kind described, a toner serving as a developer and silicone coated on a carrier sequentially deposit on the surface of a photoconductive element as the image recorder repeats its operation. It has been customary to cope with such deposits by removing them from the photoconductive element by use of a polishing material or by replacing the whole photoconductive element with another. This kind of approach, however, relies on time-consuming manual work and is apt to fail to clean the photoconductive element satisfactorily. Another approach heretofore proposed is to maintain a brush which contains or holds a polishing material in contact with the surface of the photoconductive element. This brings about another drawback that the brush is apt to scratch the surface of the photoconductive element and to allow the collected deposits to adhere again to the photoconductive element.

SUMMARY OF THE INVENTION

It is therefore an object of the present invention to provide a device applicable to an image recorder for removing deposits from the surface of a photocondutive element of the image recorder without effecting the element.

It is another object of the present invention to provide a generally improved device for removing deposits from a photoconductive element of an image recorder.

A device for removing deposits from the surface of a photoconductive element which is installed in an image recorder of the present invention comprises a removing member for removing the deposits in contact with the surface of the photoconductive element, and driving members for driving the removing member into and out of contact with the surface of the photoconductive element.

BRIEF DESCRIPTION OF THE DRAWINGS

The above and other objects, features and advantages of the present invention will become more apparent from the following detailed description taken with the accompanying drawings in which:

FIG. 6 is a table useful for understanding a relationship between the linear velocity of a photoconductive element and the duration of a deposit removing operation which was determined by experiments;

FIGS. 8A and 8B are fragmentary front views each showing a specific configuration of a fur brush;

FIG. 9 is a table useful for understanding a relationship between the deposit removability and the damage to a photoconductive element;

DESCRIPTION OF THE PREFERRED EMBODIMENTS

Figure 1:
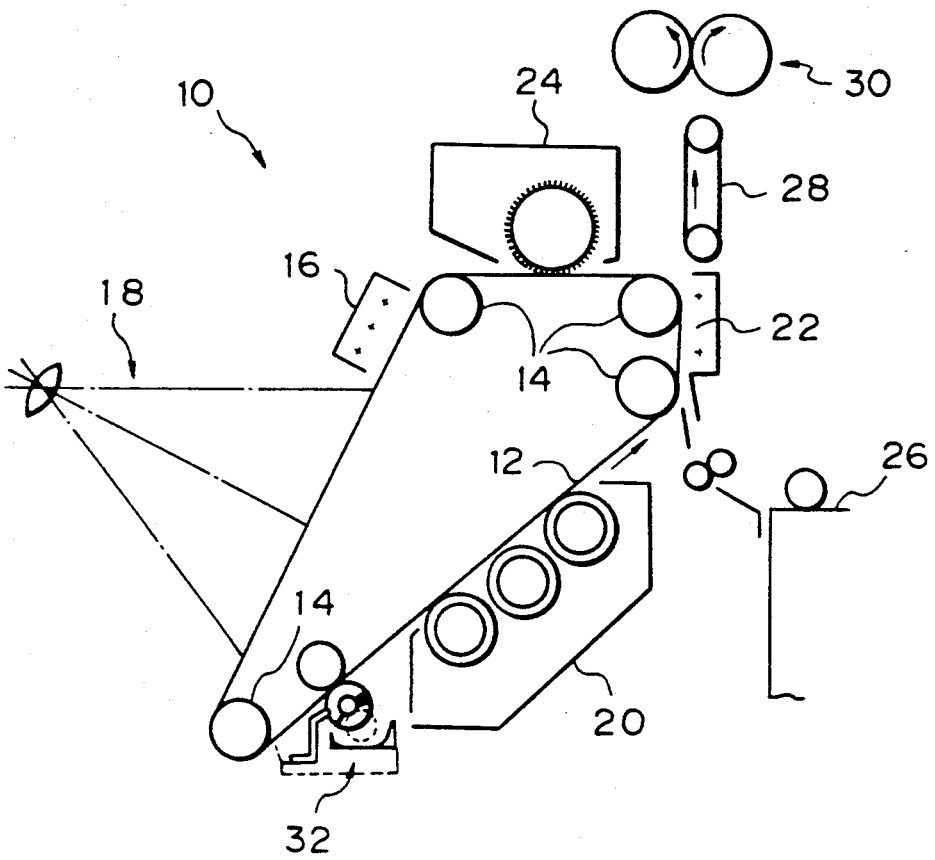
FIG. 1 is a vertical section showing an electrophotographic copier representative of image recorders and to which a device embodying the present invention is applied.

Referring to FIG. 1 of the drawings, an electrophotographic copier belonging to a family of image recorders and to which a deposit removing device embodying the present invention is applied is shown. The copier, generally 10, has a photoconductive element in the form of a belt 12 which is passed over a plurality of rollers 14 to be movable in a predetermined direction. Arranged around the belt 12 are a main charger 16, optics 18 for imagewise exposure, a developing unit 20, an image transfer and separation charger 22, a cleaning unit 24, etc. A paper feeder 26 is disposed below the image transfer and separation charger 22, while a transport belt 28 and a fixing unit 30 which is constituted by a fixing roller pair are disposed above the charger 22. The cleaning unit 24 has a conventional configuration for removing toner which remains on the belt 12 after imagewise transfer. A deposit removing device 32 embodying the present invention is located close to the belt 12 between the developing unit 20 and the optics 18.

Figure 2:
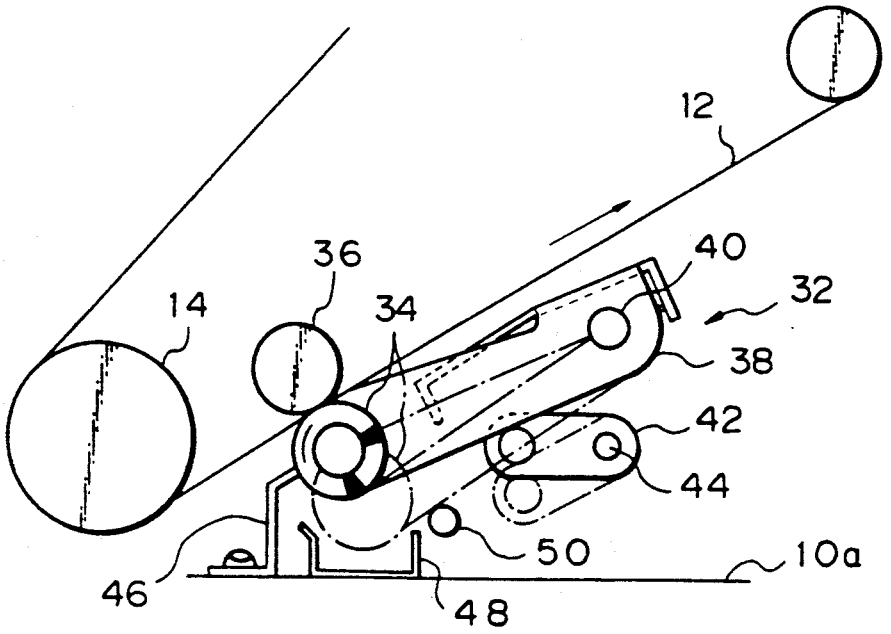
FIG. 2 is an enlarged side elevation of the device of the present invention which is applied to the copier of FIG. 1.

As shown in detail in FIG. 2, the deposit removing device 32 is mounted on a stationary member 10*a* which forms a part of the copier 10. The device 32 includes a fur-brush 34 and a back-up roller 36 which faces the fur-brush 34 with the intermediary of the belt 12. The fur-brush 34 is rotatably mounted on an arm 38 which is in turn rotatably supported by a shaft 40. As shown in the figure, the arm 38 is movable between an operative position and an inoperative position which are indicated by a solid line and a phantom line, respectively. A pressing lever 42 is positioned below the arm 38 and is rotatable about a shaft 44. The fur-brush 34 is brought into contact with the belt 12 when the arm 38 is driven by the lever 42. Specifically, the lever 42 is operatively connected to a solenoid or similar actuator (not shown) and cooperates with the arm 38 to constitute means for driving the fur-brush 34.

Ball bearings are individually mounted on opposite ends of the fur-brush 34 and back-up roller 36, although not shown in the figures. The outer races of the associated ball bearings abut against each other to determine the depths to which the fur-brush 34 and back-up roller 36 bite into the belt 12 from the opposite sides of the latter. Particularly, an arrangement is so made as to cause the back-up roller 36 to bite into the belt 12 toward the fur-brush 34 by 1 to 2 millimeters. A flicker 46 is located such that its tip penetrates into the fur-brush 34 to a depth of 0.5 millimeter or so. In this configuration, deposits removed from the belt 12 by the fur-brush 34 are shaked off from the fur-brush 34 by the flicker 46 to be collected on a tray 48, as described in detail later. A stop in the form of a shaft 50 is provided for stopping the arm 38 at the inoperative position. The fur-brush 34 may be implemented by looped filaments of acryl, polyamid or similar synthetic resin to which carbon is added as a conductor. It is to be noted that the brush-like configuration is only illustrative and may even be replaced with a body of elastic material or foam urethane containing polishing powder, a blade of urethane rubber, etc.

Figure 3:
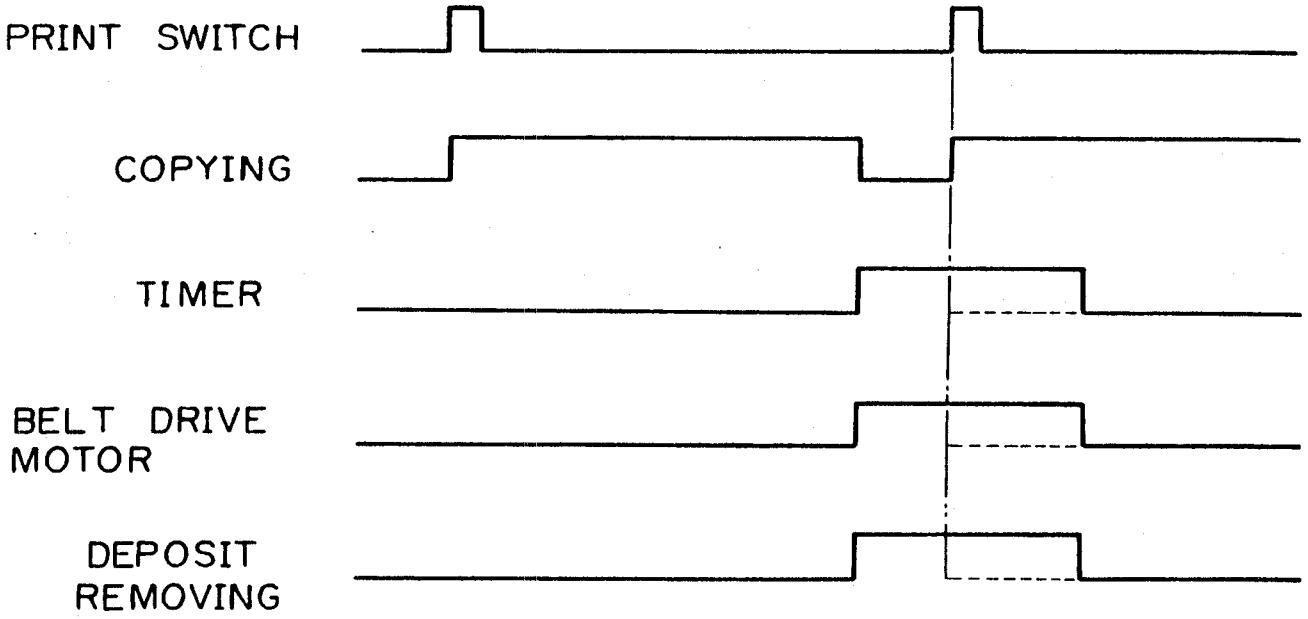
FIG. 3 is a timing chart demonstrating the operation of the device shown in FIGS. 1 and 2.
Figures 4, 4A:
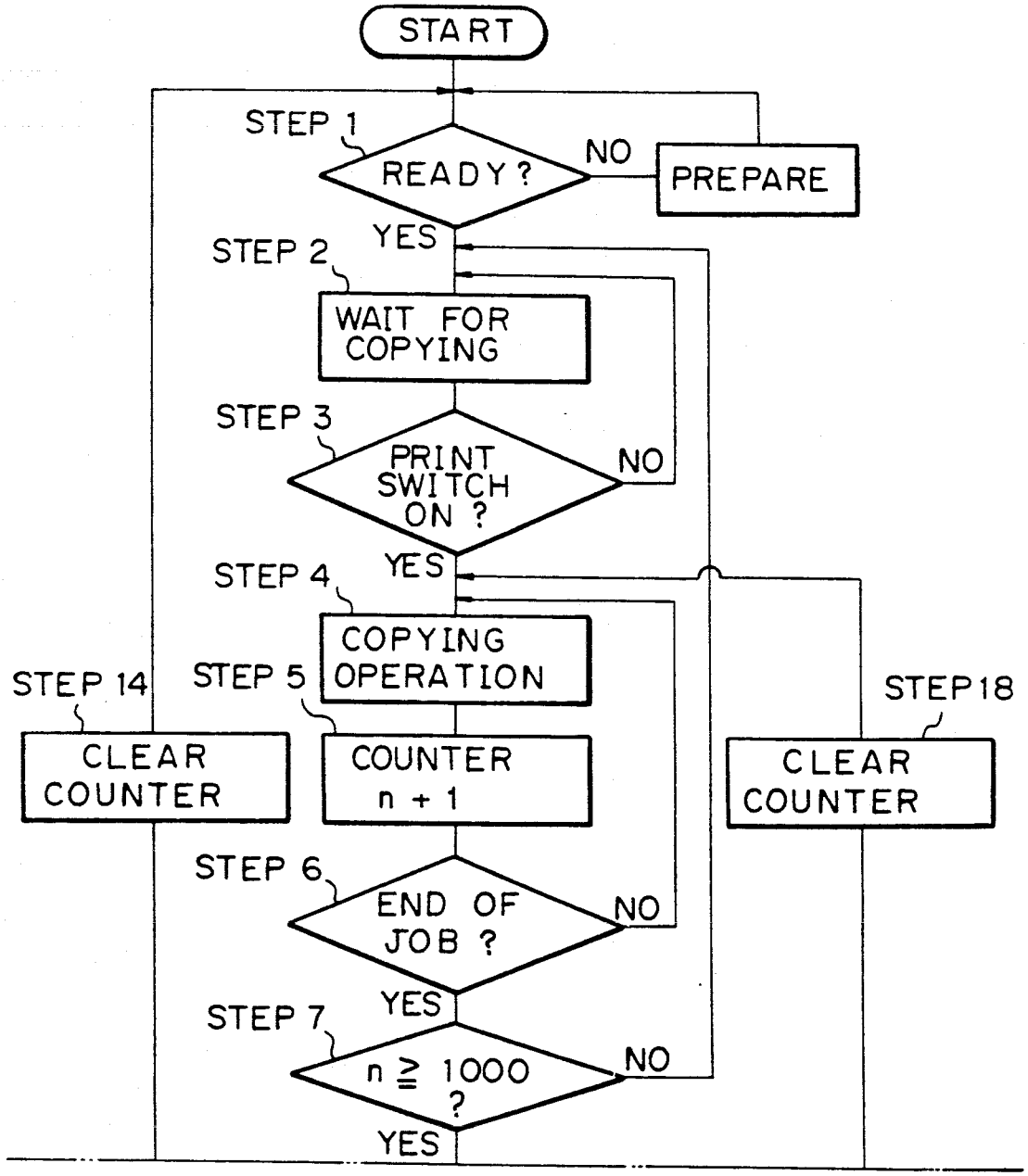
FIGS. 4 and 5, which consist of FIGS. 4A and 4B and FIGS. 5A and 5B, are flowcharts each showing a specific operation of the embodiment.
Figure 4B:
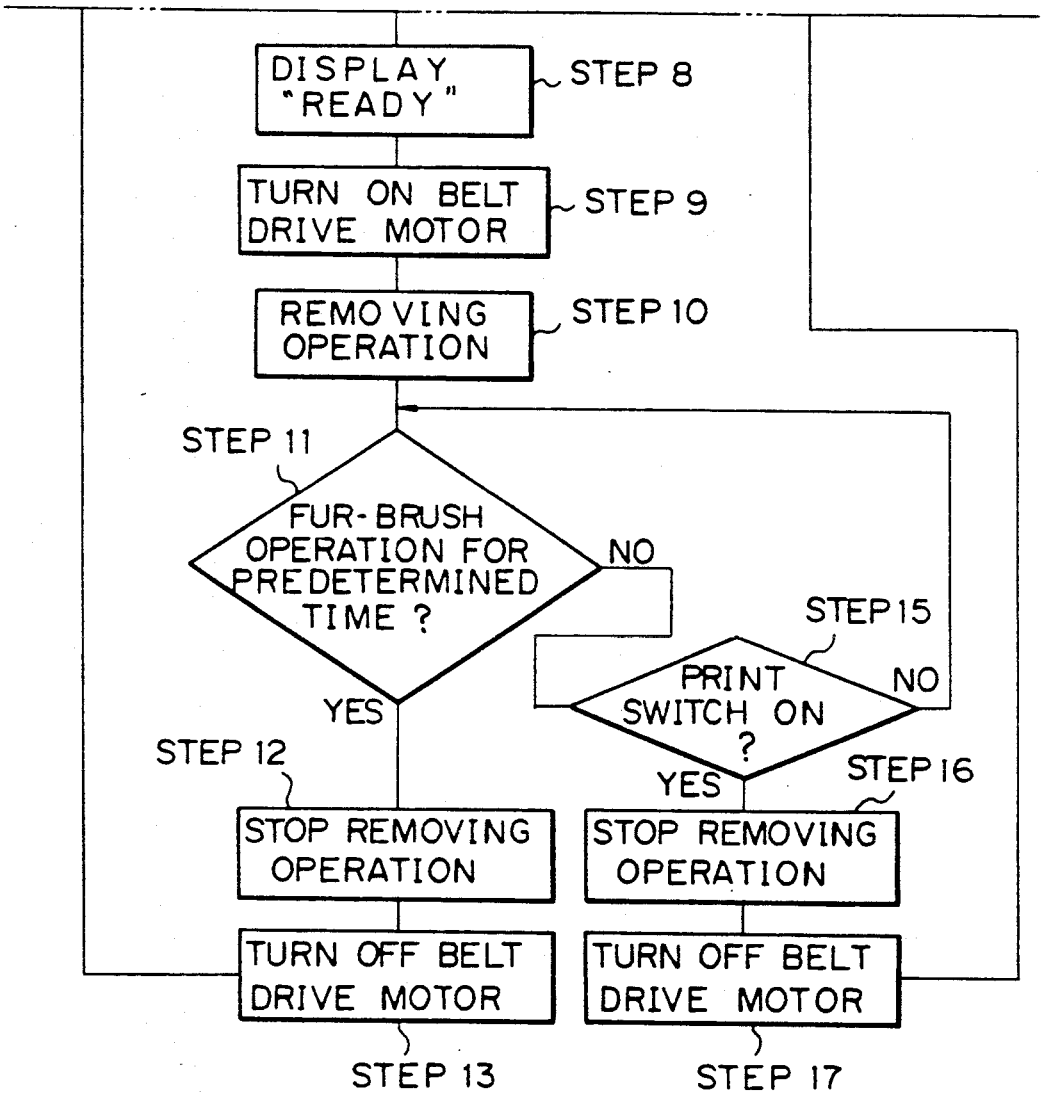

The operation of the deposit removing device 32, i.e., the fur-brush 34 will be described with reference to FIGS. 3 and 4. Assume that a print switch (not shown) of the copier 10 is pressed after the copier 10 has become ready to operate. While a latent image electrostatically formed on the belt 12 is transported via the position where the fur brush 34 is located, the fur-brush 34 is held in the inoperative position spaced apart from the belt 12 by the arm 38 and lever 42. Specifically, the program shown in FIG. 4 begins with a STEP 1 for determining whether or not the copier 10 is in a ready state. If the answer of the STEP 1 is YES, the program awaits the turn-on of the print switch (STEP 2). When the print switch is turned on (STEP 3), the copier 10 starts on a copying operation (STEP 4) (see FIG. 3). As a counter counts up a desired number of copies produced (STEP 5), whether or not the job has been completed is determined (STEP 6). When the content of the counter becomes equal to or greater than a predetermined number (assumed to be 1000 for illustration) after the completion of the job (STEP 7), that the copier 10 is in a ready state is displayed (STEP 8). Then, the belt 12 is driven by a motor in a rotary motion with no regard to the copying operation (STEP 9), while the lever 42 is rotated to cause the fur-brush 34 into contact with the belt 12 through the arm 38 so as to start removing deposits from the belt 12. The operation for removing the deposits is controlled on the basis of the content of the counter. Specifically, as the fur-brush 34 operates a predetermined period of time (STEP 11), the lever 42 and arm 38 are driven to release the fur-brush 34 from the belt 12 (STEP 12). Then, the belt 12 is brought to a halt (STEP 13), and the counter is reset (STEP 14) for restoring the copier 10 to a ready state. Such a sequence of steps is represented by solid lines in FIG. 3. Assume that the print switch of the copier 10 is pressed while the device 32 is in operation (STEP 15). At this instant, an override step is activated with the result being that the fur-brush 34 is immediately released from the belt 12 (STEP 16) and the movement of the belt 12 is stopped (STEP 17), as mentioned above. The copier 10 then starts on a copying operation (STEP 4). This kind of sequence is represented by phantom lines in FIG. 3.

Figures 5, 5A:
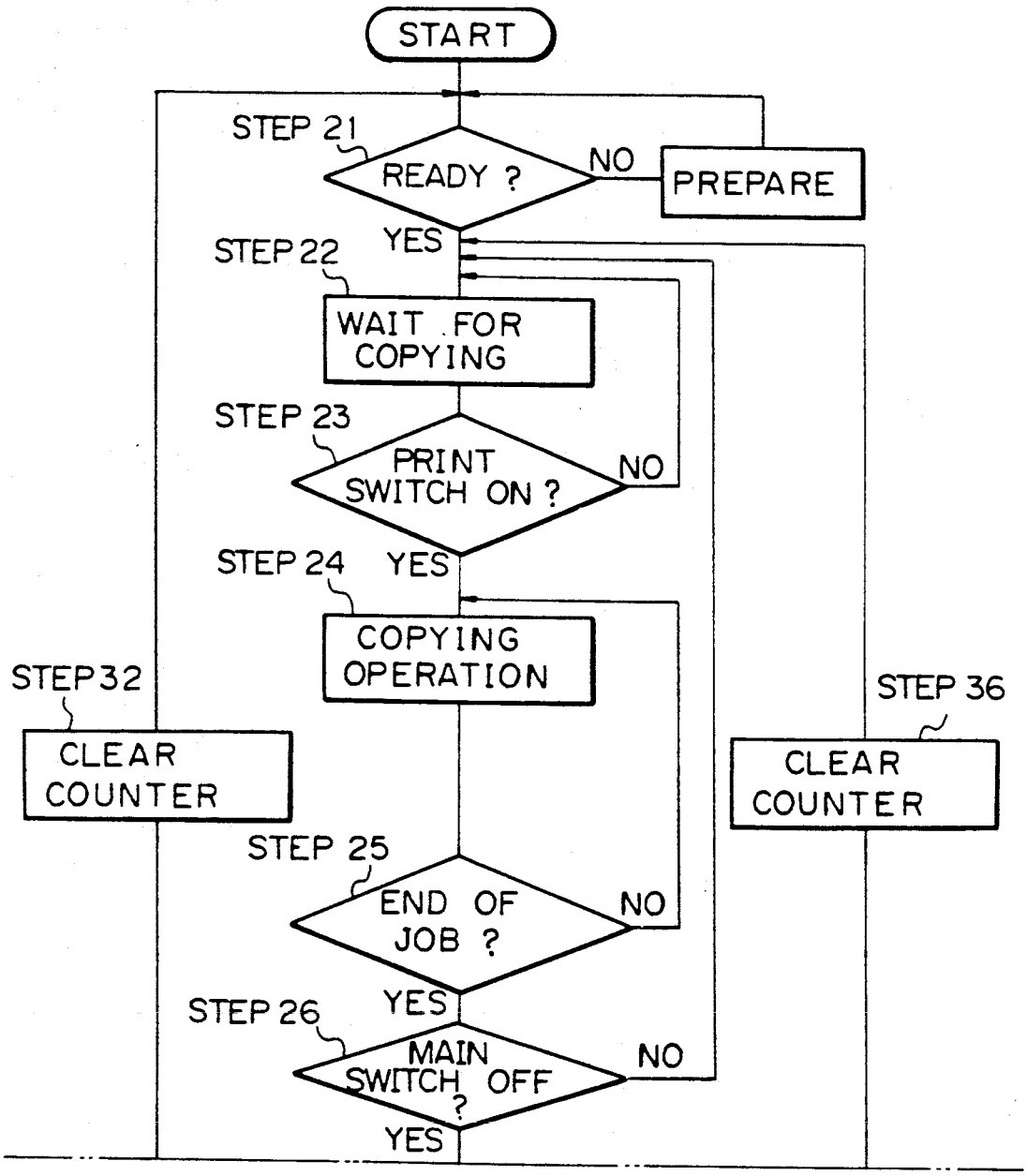
Figure 5B:
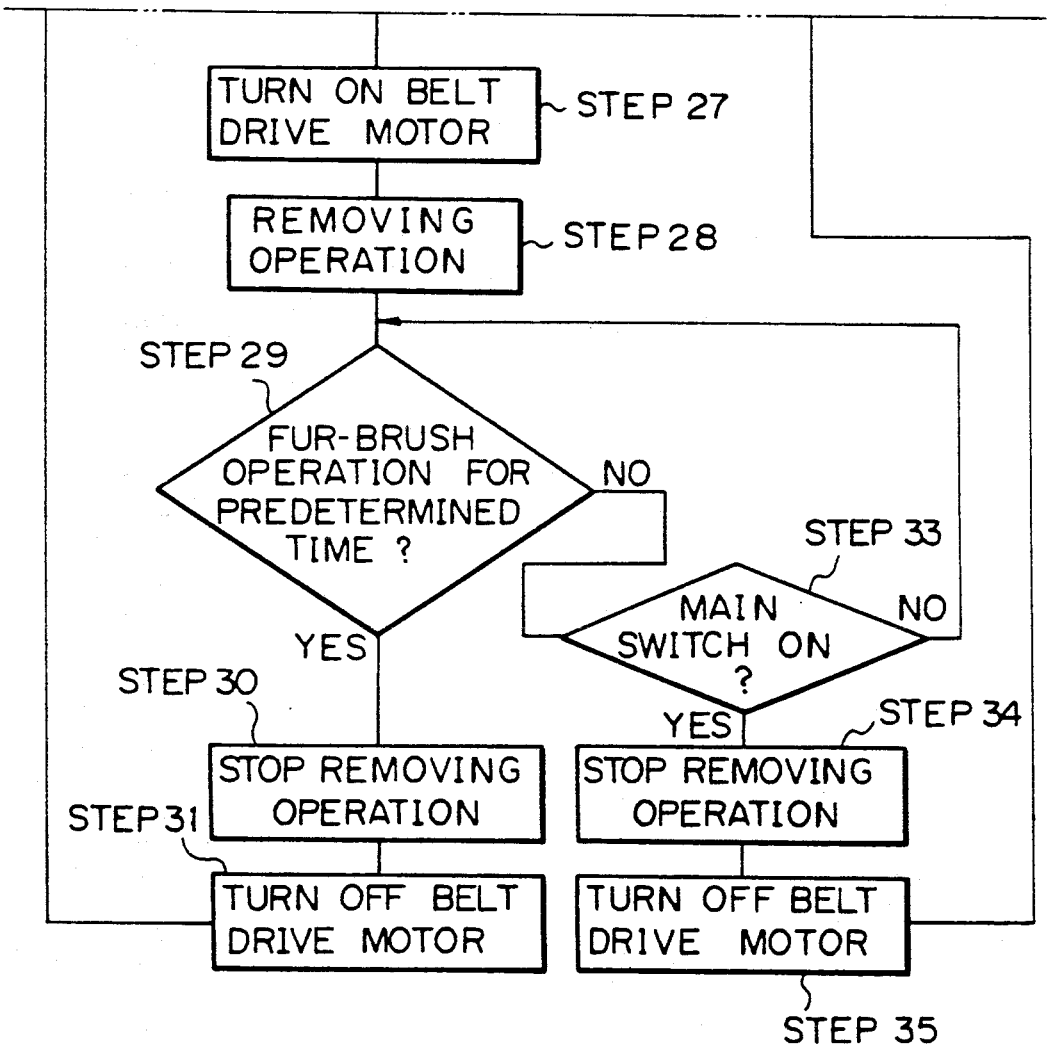

Another specific operation of the device 32, i.e., the fur-brush 34 is shown in FIG. 5. As shown, the operation begins with a STEP 21 for determining whether or not the copier 10 is in a ready state. If the answer of the STEP 21 is YES, the program awaits the turn-on of the print switch (STEP 22). When the print switch is turned on (STEP 23), the copier 10 starts on a copying operation (STEP 24). As a counter counts up a desired number of copies produced, whether or not the job has been completed is determined (STEP 25). When a main switch of the copier 10 is turned off after the completion of the job (STEP 26), the belt 12 is driven by a motor in a rotary motion with no regard to the copying operation (STEP 27), while the lever 42 is rotated to cause the fur-brush 34 into contact with the belt 12 through the arm 38 so as to start removing deposits from the belt 12 (STEP 28). The operation for removing deposits is controlled on the basis of the content of the counter. Specifically, as the fur-brush 34 operates a predetermined period of time (STEP 29), the lever 42 and arm 38 are driven to release the fur-brush 34 from the belt 12 (STEP 30). Then, the belt 12 is brought to a halt (STEP 31), and the counter is reset (STEP 32) for restoring the copier 10 to a ready state. When the main switch is turned on while the deposit removing operation is under way (STEP 33), the fur-brush 34 is released from the belt 12 (STEP 34), the movement of the belt 12 is stopped (STEP 35), and the counter is reset (STEP 36), as mentioned above. The copier 10 then starts on a copying operation (STEP 22).

As stated above, the fur-brush 34 is operated to remove deposits from the belt 12 every time a predetermined number of copies are produced after the completion of the copying job or, alternatively, when the main switch of the copier 10 is turned off. The brush 34, therefore, readily removes the deposits from the belt 12 without interfering with the copying operations. This is especially desirable when it comes to a high-speed copier. In addition, the device 32 substantially frees the belt 12 from scratches and other occurrences, compared to a device of the kind having deposit removing means which is constantly held in contact with a photoconductive element.

Experiments showed that the adhesion of deposits which just begin to adhere to a photoconductive element (after 10 to 20K runs) is weak enough for the deposits to be removed by a straight-bristle brush, and that the linear velocity of the photoconductive element during the removal of deposits by a fur-brush plays an important role in the removal of deposits.

FIG. 6 is a table showing a relationship between the linear velocity of a photoconductive element and the duration of a deposit removing operation. In the table, circles, triangles and crosses are representative of complete removal, not complete but acceptable removal, and incomplete removal, respectively. The results of FIG. 6 were obtained by using an acryl-based fur-brush, causing the brush to bite to a depth of 1.0 millimeter, rotating the brush at a speed of 500 revolutions per minute, and with a photoconductive element being operated by 20K runs.

As shown in FIG. 6, efficient removal of deposits is achievable when the linear velocity of a photoconductive element during removal is lower than a linear velocity for ordinary copying processes (300 millimeters per second). Especially, when the photoconductive element was rotated at a low linear velocity of 5 millimeters per second, deposits were fully removed from a photoconductive element within a short period of time.

Figure 7:
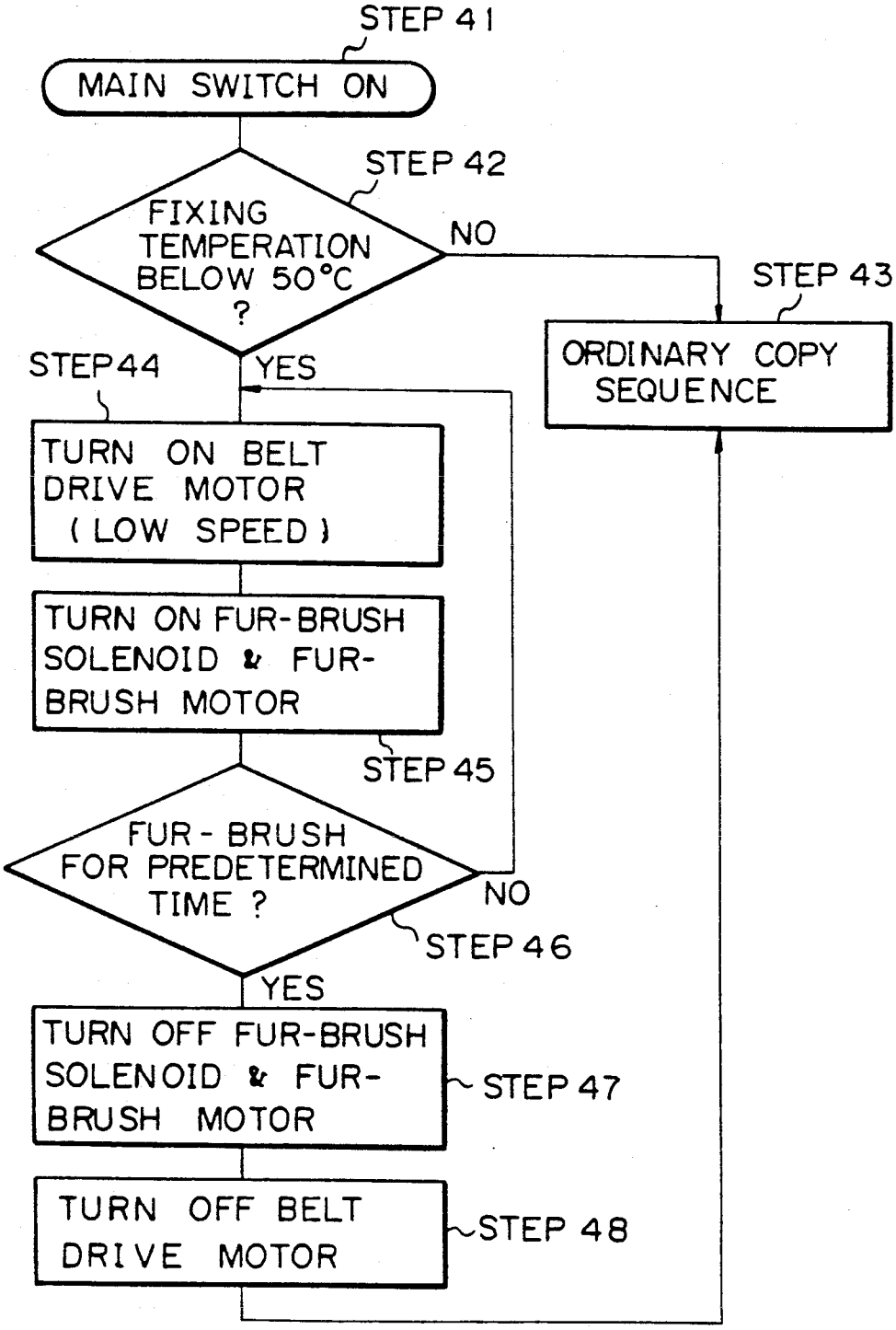
FIG. 7 is a flowchart demonstrating a specific operation associated with an alternative embodiment of the present invention.

Referring to FIG. 7, another specific operation in accordance with the present invention is shown which implements the above-stated control over the linear velocity of the belt 12. As shown, when the main switch of the copier 10 is turned on (STEP 41), whether or not the fixing temperature is lower than 50 degrees centigrade is determined (STEP 42). If the answer of the STEP 42 is YES, the program decides that the main switch has been turned on for the first time in the morning and enters into a deposit removing sequence (STEP 44 and successive steps). If the answer of the STEP 42 is NO, the program enters into an ordinary copying sequence (STEP 43). In the deposit removing sequence, the belt 12 is rotated at a low linear velocity (STEP 44), the fur-brush is brought into contact with the belt 12, and a fur-brush solenoid and a fur-brush motor are turned on to start a deposit removing operation (STEP 45). The duration of such a removing operation is controlled by a timer (STEP 46). Then, the fur-brush solenoid and fur-brush motor are turned off to release the belt 12 from the fur-brush 34 and to stop the rotation of the brush 34 (STEP 47), and the belt drive motor is deenergized to stop the movement of the belt 12 (STEP 48). This is followed by the ordinary copying sequence (STEP 43). By removing the deposits from the belt 12 every morning as stated above, it is possible to easily remove deposits from the belt 12 within a short period of time.

FIGS. 8A and 8B each shows a specific configuration of the fur-brush 34 of the deposit removing device 32. In FIG. 8A, the fur-brush 34 is implemented by filaments of metal such as stainless steel and has looped tips 34*a*. More specifically, the fur-brush 34 shown in FIG. 8A has filaments of stainless steel whose diameter is about 6 microns to 30 microns. Such filaments are infixed to a base cloth by knitting such that their tips 34*a* form loops, and the base cloth with the filaments is wound spirally around a core of metal. On the other hand, the fur-brush 34 shown in FIG. 8B has filaments in the form of straight bristles which are implanted in a base cloth or directly in a metal core.

Referring to FIG. 9, there is shown a relationship between the diameters and tip configurations of the fur-brushes shown in FIGS. 8A and 8B and the deposit removability and damage to a photoconductive element. To determine the relationship, experiments were conducted under the following conditions:

(a) material of brush:stainless steel filaments
(b) amount of bite:1.0 millimeter
(c) rotation speed:500 revolutions per minute
(d) diameter:24 microns As shown in FIG. 9, the tip configuration shown in FIG. 8A is more desirable than the tip configuration shown in FIG. 8B with respect to the deposit removability and the damage to photoconductive element. Further, the tip configuration of FIG. 8A exhibits high deposit removability and hardly damages a photoconductive element when the diameter lies in the range of 6 microns to 30 microns. Hence, the fur-brush shown in FIG. 8A is capable of removing deposits from a photoconductive element without effecting the latter when provided with looped tips and a diameter ranging from 6 microns to 30 microns.

Figures 10, 10A:
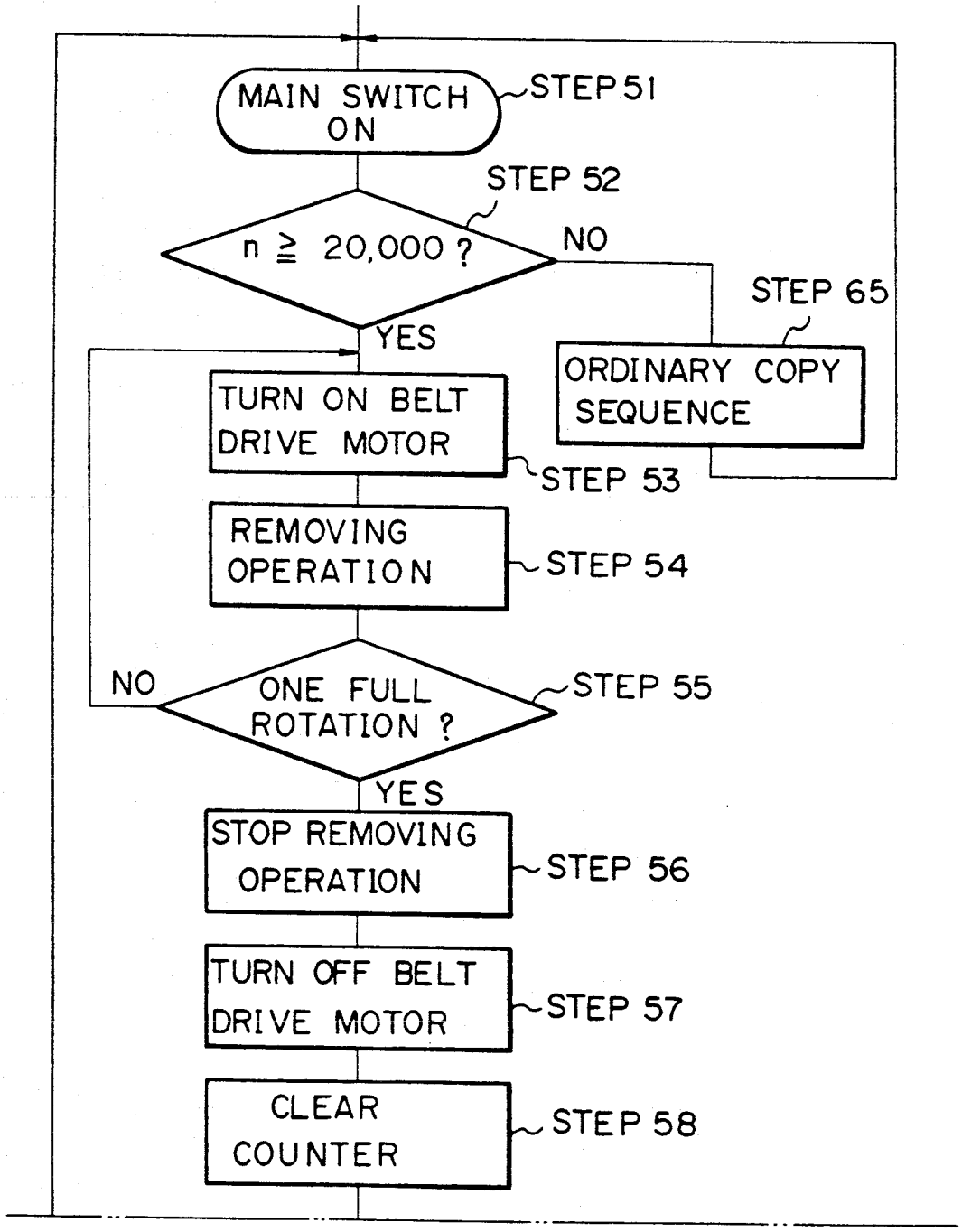
FIG. 10, which consists of FIGS. 10A and 10B, is a flowchart representative of a specific operation of another alternative embodiment of the present invention.
Figure 10B:
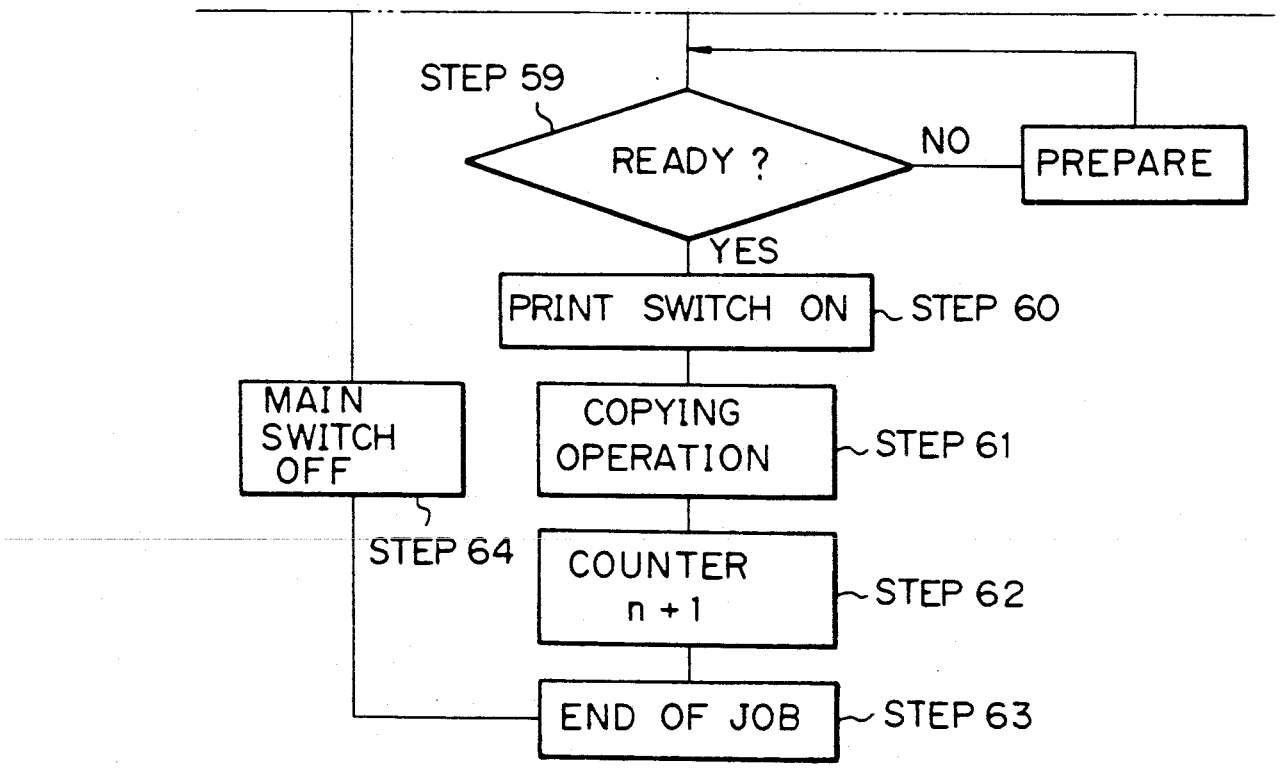

Referring to FIG. 10, another specific operation of the deposit removing device 32, i.e., the fur-brush 34 is shown in a flowchart. As shown, when the main switch of the copier is turned on (STEP 51), whether or not a counter has been incremented beyond a desired number of copies (in this case, the number is assumed to be 20000) is determined (STEP 52). If the answer of the STEP 52 is YES, the belt 12 is rotated with no regard to the copying operation (STEP 53). Simultaneously, the fur-brush 34 is brought into contact with the belt 12 through the arm 38 to start removing deposits from the belt 12 (STEP 54). As the belt 12 completes one full rotation (STEP 55), the lever 42 and arm 38 are so operated as to move the fur-brush 34 away from the belt 12 to thereby end the removal of deposits (STEP 56). Then, the rotation of the belt 12 is stopped and the counter is reset (STEP 58), whereby the copier 10 becomes ready to start on a copying operation (STEP 59). It is noteworthy that such a deposit removing operation begins and ends in a non-image area of the belt 12. This is successful in preventing a difference in image quality between a portion where the removing operations overlap (resulting in an apparent increase in sensitivity) and the other portion from appearing on a reproduction and, therefore, in guaranteeing high-quality reproductions. When the print switch is turned on (STEP 60), the copier 10 starts on a copying operation (STEP 61). After a desired number of copies have been counted (STEP 62) and, then, the job has been completed (STEP 63), the main switch is turned off (STEP 64). If the copy counter has not reached 20000 as decided in the STEP 52, the copier 10 enters into the ordinary copying sequence. (STEP 65).

As stated above, by beginning and ending a deposit removing operation in a non-image area of the belt 12, it is possible to prevent a portion where such removing operations overlap from appearing on a reproduction and, therefore, to insure high-quality reproductions.

Figure 11:
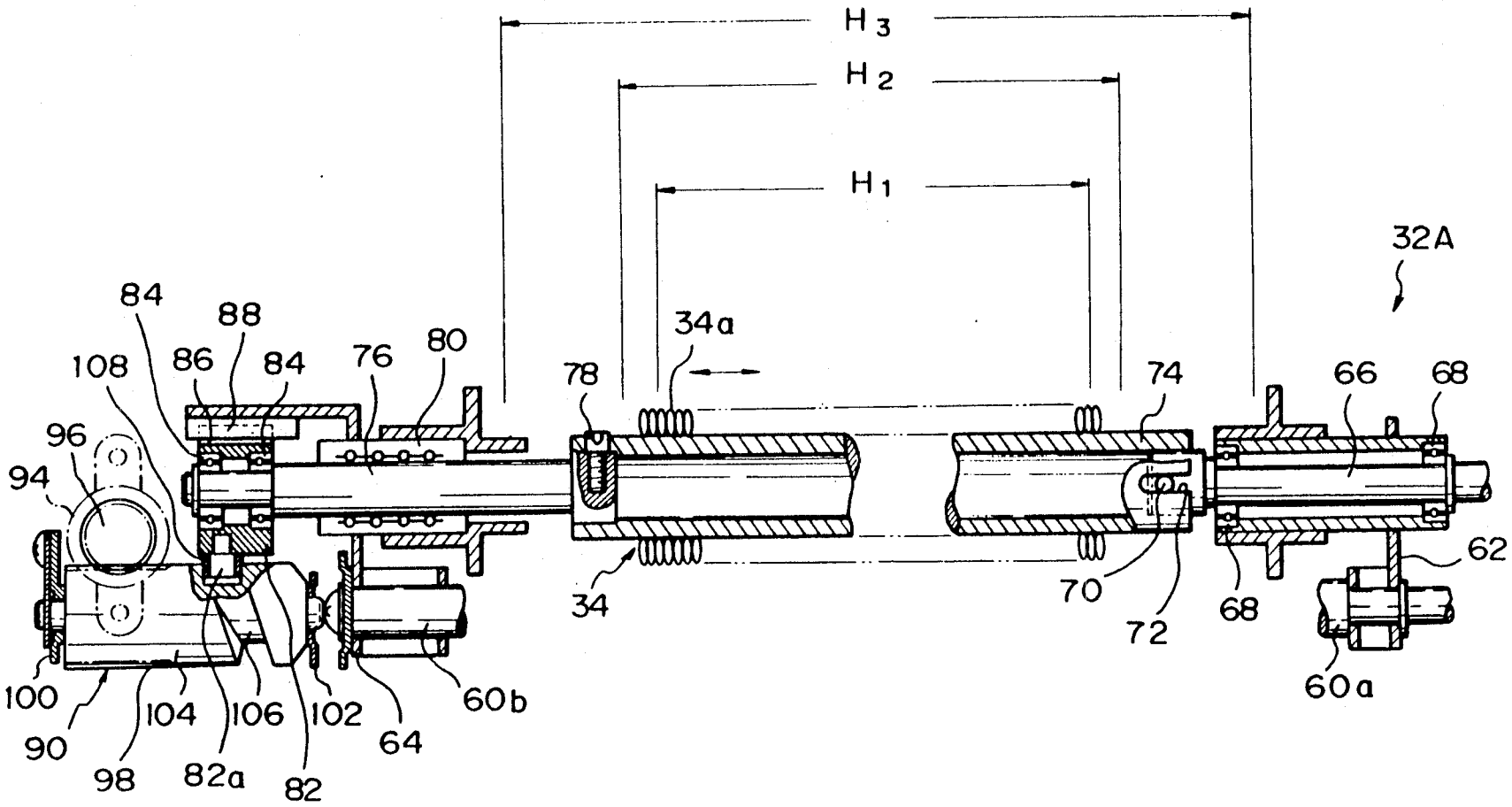
FIG. 11 is a fragmentary section showing another alternative embodiment of the present invention.
Figure 12:
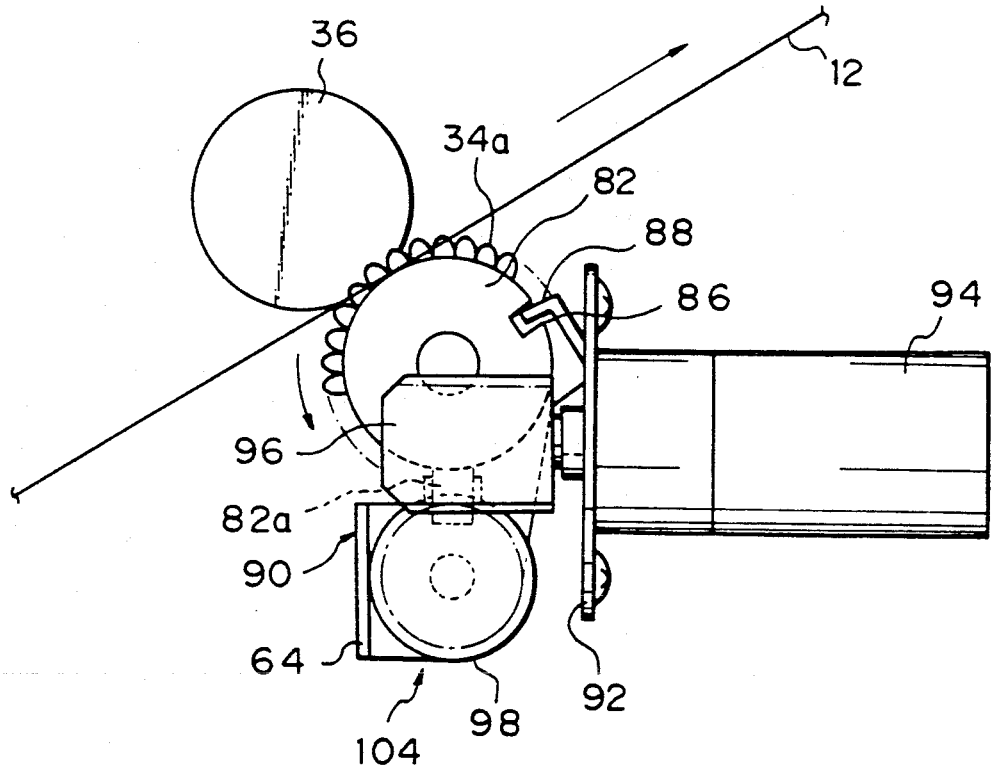
FIG. 12 is a front view of the embodiment shown in FIG. 11.

Referring to FIGS. 11 and 12, and alternative embodiment of the present invention is shown. As shown, the deposit removing device, generally 32A, has a support shaft 60*a* and 60*b* which is rigidly mounted on a unit which is not shown. A pair of arms 62 and 64 are rotatably mounted on the support shaft 60*a* and 60*b*. A drive shaft 66 is rotatably supported by the free end of the arm 62 through a bearing 68 and is rotated by a drive source (not shown). A pin 70 is studded on the outer periphery of the drive shaft 68 in one end portion of the latter. A hollow cylindrical metal core 74 has a generally U-shaped notch 72 and is movably coupled over the above-mentioned one end portion of the drive shaft 68, the pin 70 being received in the notch 72. In this configuration, the rotation of the drive shaft 68 is transmitted to the metal core 74 via the pin 70. The fur-brush 34 is wound spirally around the metal core 74 and has filaments of stainless steel. The filaments are implanted in a base cloth by knitting such that their tips form loops. A reciprocating drive shaft 76 is received in the other end of the metal core 74 and fixed to the latter by a screw 78. This shaft 76 is supported by the free end of the other arm 64 through a bearing 80 so as to be rotatable and axially movable. Hence, when the drive shaft 76 is moved in a reciprocating motion, the metal core 74 will also be moved in a reciprocating motion while causing the notch 72 to thrust the pin 70 with its wall.

A cam follower 82 is mounted on the other end of the reciprocating drive shaft 76 through a bearing 84. Therefore, the rotation of the drive shaft 76 is not transmitted to the cam follower 82. The cam follower 82 is provided with an axially extending channel 86. An angled lug 88 extends out from the end of the arm 64 and is received in the axial channel 86 of the cam follower 82, whereby the cam follower 82 is prevented from rotating. The lug 88 extends over a particular range in which the drive shaft 76 is expected to reciprocate. A reciprocation generating mechanism 90 drives the cam follower 82 in an axial reciprocating motion. Specifically, the mechanism 90 has a miniature motor 94, FIG.

12, which is mounted on a stationary member 92. The motor 94 has an output shaft on which a worm gear 96 is securely mounted. The worm gear 96 is held in constant mesh with a helical gear 98 to reduce the rotation speed. The helical gear 98 is provided on the outer periphery of a transforming member 104 which is in turn rotatably supported by opposite stationary pieces 100 and 102. The transforming member 104 has a cam groove 106 on the periphery thereof. A pin 82*a* is studded on the cam follower 82 and received in the cam groove 106. The axis of rotation of the transforming member 104 is aligned with that of the arm members 62 and 64. A rotatable collar 108 is coupled over the pin 82*a* to prevent the latter from making contact with the walls of the cam groove 106.

The operation of the deposit removing device 32A having the above construction will be described hereinafter.

The device 32A, like the device 32, is so constructed as to make contact with the belt 12 while in operation only, for the purpose of eliminating stresses otherwise acting on the belt 12. Specifically, when a fur-brush drive solenoid is energized, a gear unit is lowered. On the lapse of 1 second, a fur-brush pressing solenoid is turned on to cause a pressing lever to raise the fur-brush 34 until the latter contacts the belt 12. At the same time, a gear unit is brought into mesh with a gear mounted on the drive shaft 66 so as to regulate the amount of bite of the fur-brush 34 into the belt 12. When the motor 94 is driven, the worm gear 96 is rotated counterclockwise as viewed in FIG. 11. The worm gear 96 in turn rotates the helical gear 98, i.e., the transforming member 104 counterclockwise as viewed in FIG. 12. As a result, the pin 82*a* of the cam follower 82 is moved to the right or to the left in FIG. 11. This causes the fur-brush 34 to move rightward or leftward through the cam follower 82, bearing 84 and reciprocating drive shaft 76. The fur-brush 34, therefore, removes deposits from the belt 12 while reciprocating in the axial direction and rotating about its own axis. In the illustrative embodiment, the fur-brush 34 is caused to reciprocate at a rate of twelve times per minute. In FIG. 11, $H_1$, $H_2$ and $H_3$ designate respectively the effective image width, the reciprocating width of the fur-brush 34, and the width of the belt 12.

As stated above, in the illustrative embodiment, the fur-brush 34 is movable in a reciprocating motion in the axial direction. Hence, even if the fur-brush 34 has an irregular density distribution due to the loop configuration, for example, it is prevented from leaving deposits on the belt 12 or scratching it in the same positions of the belt 12 with respect to the axial direction, enhancing high-quality reproduction. If desired, the fur-brush 34 having looped tips may be replaced with a roller made of foam urethane rubber or similar material. It is to be noted that the reciprocating mechanism shown and described is only illustrative and may be modified as desired.

While the embodiment of the present invention has been shown and described in relation to a photoconductive element in the form of a belt, it is similarly applicable to a photoconductive element in the form of a drum. When use is made of a rotary body such as the fur-brush 34, it may be rotated in the opposite direction to the belt 12 to further enhance the removal of deposits. Further, an arrangement may be made such that the reflectance of a photoconductive element is optically sensed and, when it is changed relative to a predetermined reference value, the removal of deposits is started.

In summary, it will be seen that the present invention provides a device capable of removing deposits from the surface of a photoconductive element efficiently without effecting copying operations and the photoconductive element itself.

Various modifications will become possible for those skilled in the art after receiving the teachings of the present disclosure without departing from the scope thereof.

What is claimed is:

1. A device for removing deposits from a surface of a photoconductive element which is installed in an image recorder, comprising:

removing means for removing the deposits in contact with the surface of the photoconductive element;

driving means for driving said removing means into and out of contact with the surface of the photoconductive element;

means for stopping the removing operation of said removing means after said removing means has operated for a predetermined period of time which comprises at least one full rotation of said photoconductive element; and override means for immediately stopping the removing operation of said removing means before said removing means has operated for said predetermined period of time, when a command for causing the image recorder to start on a recording operation is entered while said removing means is in operation.

2. A device as claimed in claim 1, wherein said removing means comprises a rotatable fur-brush.

3. A device as claimed in claim 2, wherein said fur-brush is constituted by numerous filaments of synthetic resin to which a conductive material is added.

4. A device as claimed in claim 2, further comprising a back-up roller located to face said fur-brush with the intermediary of the photoconductive element.

5. A device as claimed in claim 2, further comprising a flicker for shaking off deposits removed by said fur-brush, and a tray for collecting the deposits shaked off said fur-brush.

6. A device as claimed in claim 2, comprising means for rotating said fur-brush in a direction opposite to a moving direction of the photoconductive element.

7. A device as claimed in claim 1, wherein said driving means comprises an arm supporting said removing means and angularly movable between an operative position and an inoperative position, and a lever for driving said arm.

8. A device as claimed in claim 7, further comprising a stop for stopping said arm at the inoperative position.

9. A device as claimed in claim 1, wherein the photoconductive element has a linear velocity which, while said removing means is in operation, is lower than a linear velocity assigned to ordinary recording operations of the image recorder.

10. A device as claimed in claim 1, wherein the removing operation of said removing means begins and ends in a non-image area of the photoconductive element.

11. A device as claimed in claim 1, wherein said removing means comprises a rotatable brush constituted by filaments of metal.

12. A device as claimed in claim 11, wherein said filaments of metal have tips which are provided with a loop configuration.

13. A device as claimed in claim 12, wherein said filaments of metal comprise stainless steel wires having a diameter of 6 microns to 30 microns.

14. A device as claimed in claim 11, further comprising reciprocating means for moving said brush in a reciprocating motion along an axis of rotation of said brush.

15. A device as claimed in claim 1, further comprising:

means for activating said removing operation of said removing means when a fixing temperature of a fixing unit installed in the image recorder is lower than a predetermined temperature.

16. A device as claimed in claim 1, comprising:

command means for causing the image recorder to start on a recording operation; and means for stopping said removing operation after a predetermined period of time when said command means for causing the image recorder to start on a recording operation is not activated while said removing means is in operation.

17. A device as claimed in claim 1, comprising means for displaying a ready state of the image recorder even when said removing means is in operation.

18. A device as claimed in claim 1, comprising means for activating the removing operation of said removing means after the image recorder has repeated a recording operation a predetermined number of times.

19. A device as claimed in claim 1, comprising:

a main switch for said image recorder; and means for activating the removing operation of said removing means for a predetermined period of time when said main switch is turned off.

20. A device as claimed in claim 19, comprising:

means for immediately stopping the removing operation of said removing means when the main switch is turned on before said predetermined period of time expires.

21. A device as claimed in claim 1, wherein said photoconductive element has a first linear velocity which is assigned to ordinary recording operations of the image recorder, and a second linear velocity which is lower than the first linear velocity, which is assigned during the removing operation of said removing means, wherein said removing operation occurs at said second linear velocity.

22. A device as claimed in claim 21, wherein said second linear velocity of the photoconductive element is 5 millimeters per second.

* * * * *